US008910664B2

(12) United States Patent
Liao et al.

(10) Patent No.: US 8,910,664 B2
(45) Date of Patent: Dec. 16, 2014

(54) NONLINEAR AIR STOP VALVE STRUCTURE

(75) Inventors: Yaw-Shin Liao, New Taipei (TW); Chieh-Hua Liao, New Taipei (TW)

(73) Assignee: AIRBAG Packing Co, Ltd., Sindian Dist., New Taipei (TW)

( * ) Notice: Subject to any disclaimer, the term of this patent is extended or adjusted under 35 U.S.C. 154(b) by 339 days.

(21) Appl. No.: 13/372,508

(22) Filed: Feb. 14, 2012

(65) Prior Publication Data

US 2013/0206259 A1 Aug. 15, 2013

(51) Int. Cl.
*F16K 15/14* (2006.01)

(52) U.S. Cl.
USPC ..... 137/846; 137/223; 446/224

(58) Field of Classification Search
CPC ... F16K 15/144; F16K 15/147; F16K 15/202; F16K 15/205; B65D 81/052; B61D 45/00; B61D 45/008; B60P 7/065; B31D 5/0073
USPC ..... 137/223, 843, 846, 844, 847; 446/224, 446/220, 221; 410/119, 125; 5/655.3
See application file for complete search history.

(56) References Cited

U.S. PATENT DOCUMENTS 568,669 A * 9/1896 Ellsworth ..... 251/149.3
1,198,687 A * 9/1916 Williams et al. ..... 5/655.3
1,579,502 A * 4/1926 Blakeslee ..... 441/123
2,799,314 A * 7/1957 Dreyer et al. ..... 383/44
3,282,412 A * 11/1966 Corella et al. ..... 206/221
3,302,859 A * 2/1967 Perry ..... 383/103
3,313,472 A * 4/1967 Tjerneld et al. ..... 383/44
3,364,941 A * 1/1968 Harder ..... 137/849
3,565,078 A * 2/1971 Vailliancourt et al. ..... 604/256
3,988,792 A * 11/1976 Klein ..... 40/736
4,586,974 A * 5/1986 Nystrom et al. ..... 156/165
4,966,197 A * 10/1990 Jaron et al. ..... 137/846
5,308,163 A * 5/1994 Abe ..... 383/44
5,336,123 A * 8/1994 Laske et al. ..... 446/224
5,469,966 A * 11/1995 Boyer ..... 206/522
5,527,012 A * 6/1996 Vinkel et al. ..... 249/61
5,558,441 A * 9/1996 Morrison et al. ..... 383/100
5,595,521 A * 1/1997 Becker ..... 446/224
5,826,723 A * 10/1998 Jaszai ..... 206/522
5,830,780 A * 11/1998 Dennison et al. ..... 428/68
5,857,571 A * 1/1999 Tschantz et al. ..... 206/522
5,860,441 A * 1/1999 Garcia ..... 137/15.18
5,878,768 A * 3/1999 Tarazaga Carrasco .... 137/15.17
5,934,310 A * 8/1999 Littlehorn ..... 137/223
6,015,601 A * 1/2000 Garcia ..... 428/35.8
6,027,394 A * 2/2000 Tarazaga Carrasco ..... 446/224
6,170,513 B1 * 1/2001 Lo ..... 137/223
6,247,488 B1 * 6/2001 Peterson ..... 137/223

(Continued)

*Primary Examiner* — Craig Schneider
*Assistant Examiner* — Craig J Price

(57) ABSTRACT

A nonlinear air stop valve of an air sealing body includes an inner member having left arcs on one side and right arcs on the other side, and both left and right arcs are asymmetrically arranged sideway, and a breach is formed at the bottom of the left and right arcs and on a concave arc surface, and left and right arcs are arranged from top to bottom, such that air entering from an air inlet at the top of the inner membrane flows along an upper arc of the left and right arcs to a lower arc and is blocked by the concave arc surface to flow to the breach and pass through the right arc, breach, left arc and breach in turn from right to left or from left to right into an air outlet at the bottom of the inner membrane and enter into the sealing body.

12 Claims, 9 Drawing Sheets

(56) References Cited

U.S. PATENT DOCUMENTS

| | | | | |
|---|---|---|---|---|
| 6,446,658 | B1 * | 9/2002 | O'Brien | 137/223 |
| 6,569,283 | B1 * | 5/2003 | Sperry et al. | 156/583.2 |
| 7,249,612 | B2 * | 7/2007 | Koyanagi | 137/846 |
| 7,395,833 | B2 * | 7/2008 | Nakamura | 137/223 |
| 7,481,252 | B2 * | 1/2009 | Koyanagi | 141/114 |
| 7,533,772 | B2 * | 5/2009 | Yoshifusa et al. | 206/522 |
| 7,926,507 | B2 * | 4/2011 | Wetsch et al. | 137/223 |
| 7,934,522 | B2 * | 5/2011 | Liao et al. | 141/114 |
| 7,959,003 | B2 * | 6/2011 | Liao et al. | 206/522 |
| 7,959,759 | B2 * | 6/2011 | Liao et al. | 156/308.4 |
| 7,992,601 | B2 * | 8/2011 | Liao et al. | 137/846 |
| 8,088,459 | B2 * | 1/2012 | Liao et al. | 206/522 |
| 8,210,352 | B2 * | 7/2012 | Liao et al. | 206/522 |
| 8,360,641 | B2 * | 1/2013 | Kim | 206/522 |
| 8,419,278 | B2 * | 4/2013 | Tanaka | 137/223 |
| 8,424,552 | B2 * | 4/2013 | Wetsch et al. | 137/223 |
| 8,590,574 | B2 * | 11/2013 | Jian et al. | 137/846 |
| 2002/0166788 | A1 * | 11/2002 | Sperry et al. | 137/223 |
| 2006/0201549 | A1 * | 9/2006 | Nakamura | 137/223 |
| 2009/0050509 | A1 * | 2/2009 | Liao et al. | 206/522 |
| 2009/0155507 | A1 * | 6/2009 | Liao et al. | 137/511 |
| 2011/0233101 | A1 * | 9/2011 | Baines | 206/522 |
| 2012/0312388 | A1 * | 12/2012 | Jian et al. | 137/223 |
| 2014/0034148 | A1 * | 2/2014 | Liao et al. | 137/223 |

* cited by examiner (A-A)

NONLINEAR AIR STOP VALVE STRUCTURE

FIELD OF THE INVENTION

The present invention relates to a nonlinear air stop valve structure, in particular to an air stop valve used in an air sealing body capable of reducing the backflow of air, an inner membrane of the air stop valve, as well as an air inlet, an air outlet, an arc and a breach of the inner membrane.

BACKGROUND OF THE INVENTION

In general, an air sealing body includes an airbag for packaging and an airbag for shock absorption, and present existing air sealing bodies usually come with a one-way air stop valve for inflating the air sealing bodies, such that the air sealing body can lock the air automatically after the air sealing body is inflated through the air stop valve.

In addition, the conventional air sealing body is developed into a product with a continuous one-way air stop valve and installed to a continuous air column, such that each independent air column can be fully inflated by a one-time inflation, and after air is passed through the air stop valve, the air is locked into the air sealing body, and the continuous one-way air stop valve is introduced to bring the inflatable air column to industrial applications and become a buffering package for products. The continuous one-way air stop values of this sort can be applied for transportations or in warehouses as disclosed in Pat. Pub. No. US 2007/0267094 A1 and U.S. patent application Ser. No. 10/610,501.

However, the aforementioned structure also has a serious drawback, since the one-way air stop valve can lock air, but the capability of locking air in the air columns of the air sealing body cannot last too long. In other words, such one-way air stop valve is unable to block and prevent air in the air column from circulating and entering into the original path of the air columns and flowing back into the atmosphere, so that the air in the air columns of the air sealing body will flow to the outside slowly and unconsciously. As a result, the air in the air sealing body will be discharged to lose the buffering function.

The technical problems of the prior arts are listed as follows.

1. As disclosed in U.S. Pat. No. 6,629,777 B2, a one-way air stop valve adopts a hot structure with an arrow-shaped hot sealing pattern formed at a lower end of the one-way air stop valve, so that a gas enters from the arrow-shaped pattern into the air sealing body. If the gas flows back, the gas is blocked by the arrow-shaped pattern, but the diversion positions are still linear. In other words, a straight-line channel is formed, causing a backflow of the gas in the air sealing body.

2. In U.S. patent application Ser. No. 10/610,501, a one-way valve adopting a three-stage control is disclosed, wherein the control takes place at an inlet section, a middle diversion section, and an air outlet section, but the connection between the sections still requires maintaining a linear path for letting the air enter. However, the linear path allows the gas to flow along the linear path and back to the outside.

3. In Pat. Pub. No. US 2003/0094394 A1, an air stop valve with a linear blocking structure is disclosed, wherein a cross design is adopted, and a breach is reserved at an end of the linear path to let air enter from the breach into the next level, and the air at the level is blocked immediately to drive the air to switch its direction to move to the breach at the other end. The purpose is to block any air flowing backing in a reverse direction into the breach, so as to make the backflow difficult and achieve a good air stopping effect. However, the structure adopts a linear blocking and a turning which violates the theory of fluid dynamics. As a result, the inflation operation will be very unsmooth.

4. In Pat. Pub. No. US 2007/0267094 A1, an air stop valve structure having a wide inlet, a narrow middle section and an even wider air outlet, but this structure still adopts the concept of the linear path, and fails to avoid the problem of air flowing along the linear path back to the outside.

SUMMARY OF THE INVENTION

Therefore, it is a primary objective of the present invention to overcome the drawbacks of the prior art by providing an air stop valve used in an air sealing body capable of reducing the backflow of air, since the air in the conventional air stop valve circulates and enters into the original path of the air columns and flows back into the atmosphere easily, so that it is difficult to maintain the sealed air for long, and the invention can maintain a good buffering function of the air sealing body for too long.

To achieve the aforementioned objective, the present invention provides a nonlinear air stop valve structure, with two narrower plastic inner membranes disposed in two wider plastic outer membranes, and assembled in an air sealing body, comprising: a plurality of arcs, formed on the inner membranes by hot sealing, and disposed on both sides of the inner membrane respectively, and comprising a plurality of left arcs disposed on a side of the inner membrane, and a plurality of right arcs disposed on the other side of the inner membrane, and the left arcs and right arcs being arranged asymmetrically, and the left arc and the right arc cooperatively forming a breach formed at an end-point of the left arc and the right arc and disposed adjacent to a concave arc surface of either the left or the right arc opposite to the breach, and the plurality of left and right arcs being arranged on left and right sides from the top to the bottom to form a nonlinear air stop valve structure.

With the aforementioned structure, after the sealing body is inflated through the air stop valve structure, air enters from an air inlet at the top of the inner membrane and flows along an upper arc of the left and right arcs to a lower arc, and the air is blocked by the concave arc surface and switched to pass through the breach, and guided from the arc on the other side to the lower arc of the arc to flow into the breach, so as to constitute an airflow passing through the right arc, the breach, the left arc and the breach in turn from right to left or from left to right into an air outlet formed at the bottom of the inner membrane and enter into the sealing body.

Therefore, when the air in the sealing body flows back along the inlet path of the air stop valve, the air is blocked and guided by the left and right arcs and divides the backflow of air, such that a very small quantity of air flowing back to the air inlet, so as to achieve the effect of preventing the backflow of air without causing difficulties or unsmooth operations, and the invention can maintain a good buffering condition of the air sealing body.

Another preferred embodiment of the present invention is described as follows:

The inner membrane has a heat resisting material coated at a predetermined position of an air inlet formed on an inner side of any inner membrane, such that after the inner membrane is placed into the outer membranes and thermally sealed with the horizontal hot sealing line, the inner side of the inner membrane at the position of the heat resisting material is not thermally sealed or coupled to form an air inlet of the sealing body, and air passes through the air inlet and circulates along the left and right arcs and flows all the way to the air outlet formed at the bottom of the inner membrane to enter into the sealing body, when the sealing body is inflated.

A flow guide passage is formed between the upper and lower arcs for guiding back flowing air, and a lower end of the arc is used as a natural block when the air flows back, so that the back flowing air is blocked by the lower end of the arc, and the flow guide passage guides the blocked air accordingly into a sealed space, and the blocking and air guiding effects of the left and right arcs prevent a gas or air stored in the sealing body from flowing back to the original air inlet and prevent a backflow, so that the sealing body can maintain a long air-lock time to assure a buffering capability of the sealing body. The flow guide passage has a hot-sealing length extended to a boundary of the sealed space, so that the sealed space is partitioned into a plurality of independent sealed chambers, and gas guided from the flow guide passage will not be overlapped or interfered with one another.

The inner membrane and a single outer membrane of the sealing body are hot sealed with the arc in advance to form a seal between the air stop valve and the outer membrane, and after the sealing body is inflated, there is no internal expansion, thus an internal pressure is produced to compress the air stop valve to define an air stop and improve an air stopping effect.

Alternatively, the air stop valve is installed independently between the outer membranes, and after the sealing body is inflated, an internal pressure of the sealing body increases due to the expansion of air, so that both sides of the air stop valve are pressed to form an air stop to improve an air stopping effect.

An air route from the air inlet to the air outlet is formed between the left arc and the right arc, and the air route is used together with a conventional linear method by a nonlinear method, and the air route is used together with an upper section, or both upper and lower section as needed.

The sealing body comprises at least one air chamber formed therein and disposed between the outer membranes, and each air chamber comprises an air inlet, and the left and right arcs coupled to the air inlet and the air inlet hot sealing line of the heat resisting material are coupled closely with one another to prevent the air flowing back from a joint of the air inlet and the left and right arcs to an inflating channel of the sealing body to leak from the sealing body.

The quantity of arcs arranged at the top and bottom and the spacing between the arc and the breach are determined according to actual requirements.

The air stop valve is used separately, or installed continuously on a continuous air column type air sealing body for its use, and when an inflating channel of the continuous air column type air sealing body is inflated, the air inlet of the continuously installed air stop valve can be opened automatically, and the inner membrane further includes a heat resisting material extended to the inflating channel and a hot-sealing node on the heat resisting material is formed between the inner membrane and the outer membranes in advance, and since the inner side of the inner membrane is coated with the heat resisting material, therefore the inner side of the inner membrane is not adhered during a hot sealing, and the inner membrane and the outer membranes coupled to the inner membrane are adhered by the hot sealing, and when the inflating channel is inflated and expanded, the outer membranes are spread outwardly to pull both of the outer membrane and the inner membrane outwardly, so as to naturally inflate the inflating channel and automatically pull open the inner membrane and the air inlet.

The inflating channel of the continuous air column type air sealing body does not have any hot-sealing node but uses an inflating channel instead, and two inner membranes and two outer membranes of the air column adjacent to the air inlet are hot sealed to form a hot-sealed block, such that when the inflating channel is inflated, the hot-sealed block does not inflate or expand, the inflating channel with no hot-sealed block is expanded or contracted due to inflation to drive the two hot-sealed blocks to compress the air inlet to open the air inlet automatically.

The present invention further comprises the left and right arcs asymmetrically arranged, and the top and the bottom of the arc are connected all the way to the bottom of the inner membrane to form a sealed air route.

DESCRIPTION OF THE PREFERRED EMBODIMENTS

Figure 1:
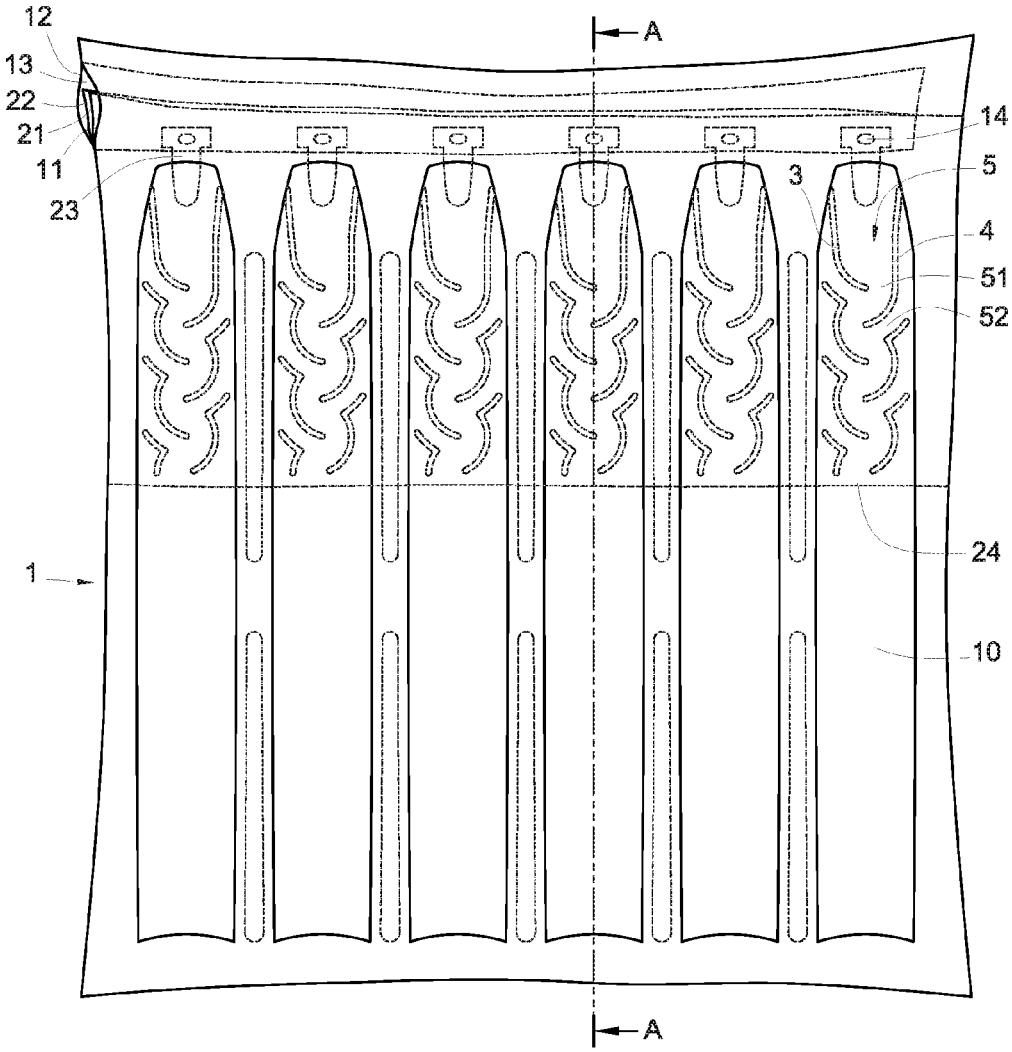
FIG. 1 is a front view of a preferred embodiment of the present invention.
Figure 2:
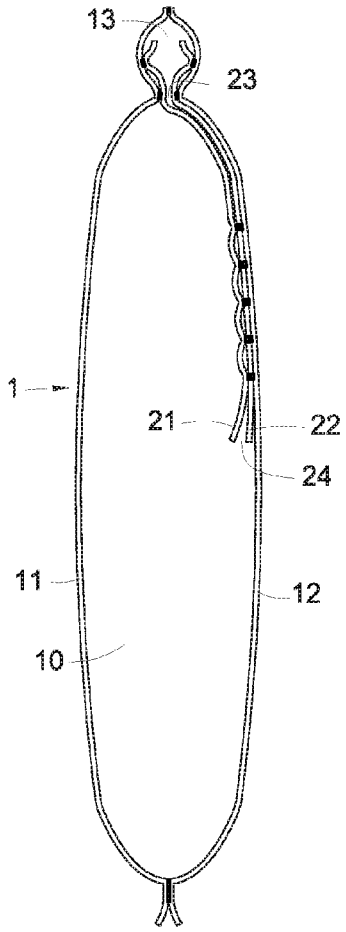
FIG. 2 is a cross-sectional view of Section A-A of FIG. 1.
Figure 3:
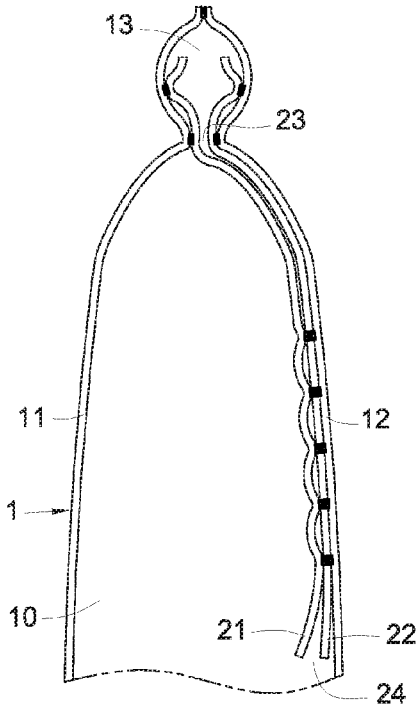
FIG. 3 is a partial blowup cross-sectional view of FIG. 2.
Figure 4:
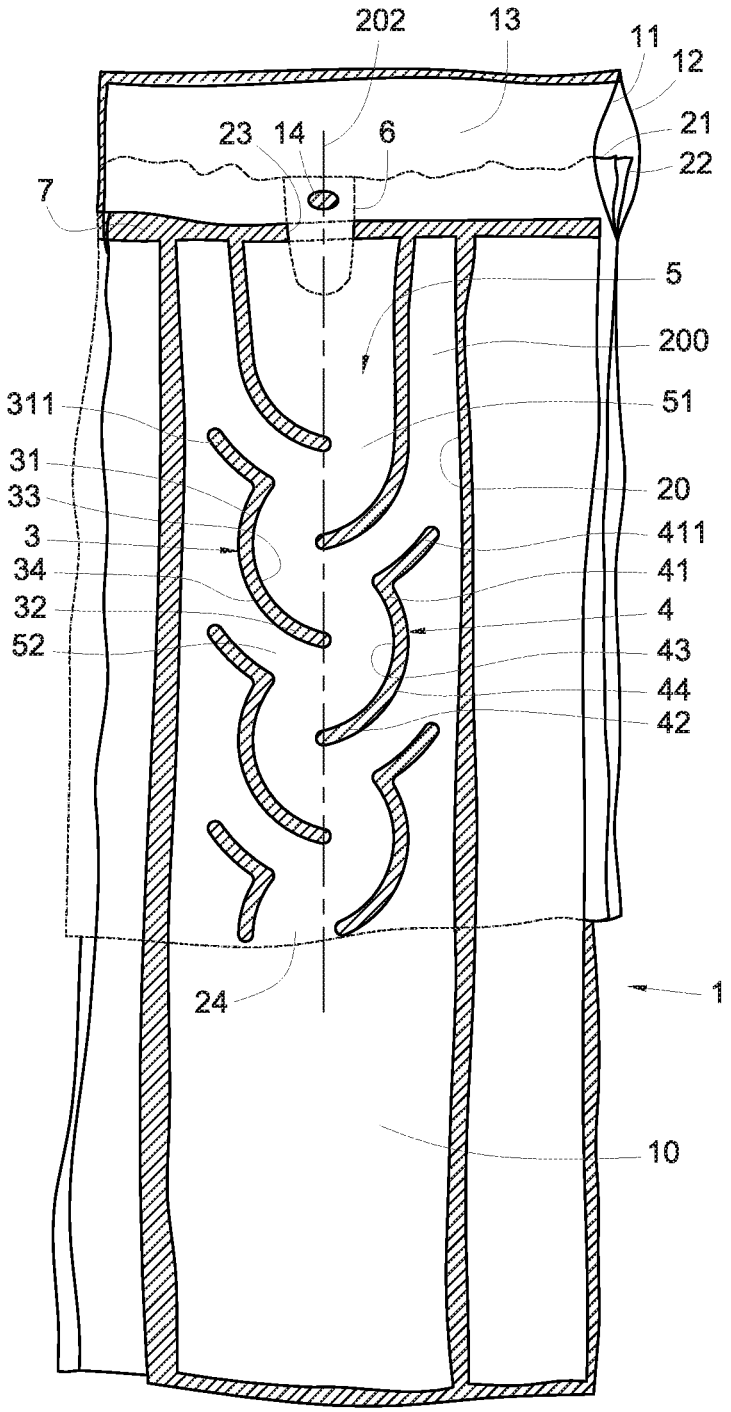
FIG. 4 is a schematic view of an air stop valve in accordance with the preferred embodiment as depicted in FIG. 1.

With reference to FIG. 1 for a front view of a preferred embodiment of the present invention as well as FIGS. 2 to 4, a nonlinear air stop valve structure of the present invention comprises two narrower plastic inner membranes 21, 22 disposed in two wider plastic outer membranes 11, 12, and assembled in an air sealing body 1.

The inner membranes 21, 22 are hot sealed, such that a plurality of arcs 3, 4 are formed between the inner membranes 21, 22, and disposed on both sides of the inner membranes 21, 22 respectively, wherein the left arcs 3 are disposed on one side of the inner membranes 21, 22, and the right arcs 4 are disposed on the other side of the inner membranes, and both left arcs 3 and right arcs 4 are asymmetrically arranged on left and right sides, and a breach 51 is formed at an end point of the left arc 3 and the right arc 4, and the breach 51 is disposed adjacent to a concave arc surface 33, 43, and plural groups of left and right arcs are arranged on left and right sides from the top to the bottom to form a nonlinear air stop valve structure.

After the sealing body 1 is inflated through the air stop valve structure, air enters from an air inlet at the top of the inner membrane 21, 22, air flows along an upper arc 31, 41 of the left and right arcs 3, to a lower arc 32, 42 and is blocked by the concave arc surface 33, 43 and switched to pass through the breach 51 and guided from the upper arc 31, 41 of the arc 3, 4 on the other side to the lower arc 32, 42 of the arc 3, 4 to enter into the breach 51, so as to constitute an airflow passing through the right arc 4, breach 51, left arc 3, and breach 51 in turn from right to left or from left to right into an air outlet 24 at the bottom of the inner membrane 21, 22 and then into the sealing body 1. Wherein, an air route 5 passing from the air inlet 23 to the air outlet 24 is formed between the left and right arcs 3, 4.

The quantity of left and right arcs 3, 4 arranged at the top and bottom, and the spacing between the left and right arcs 3, 4 and the breach 51 are determined according to actual requirements.

A flow guide passage 52 is formed between the upper arcs 31, 41 and the lower arcs 32, 42 for guiding the backflow of the air, and when the lower arc 32, 42 at a lower end of the left and right arcs 3, 4 is used for flowing back the air, the air will be blocked naturally. When the air flowing back is blocked by the lower arcs 32, 42 at the lower end of the left and right arcs 3, 4, the flow guide passage 52 guides the blocked air out to flow into a sealed space 200.

Therefore, the gas stored in the sealing body is blocked and guided by the left and right arcs 3, 4, so that it will not flow back to the original air inlet 23 to leak easily, and the sealing body 1 can maintain a long air stopping effect to assure the buffering capability of the sealing body 1.

In a preferred embodiment, the sealing body 1 includes at least one air chamber 10 formed between the outer membranes 11, 12, and the inner membranes 21, 22 are extended into the air chamber 10, and the peripheries of the inner membranes 21, 22 are coupled with one another, and a valve chamber 20 is formed between the inner membranes 21, 22, and an air inlet 23 and an air outlet 24 are formed at the top and the bottom of the inner membranes 21, 22 and interconnected to the outside and the valve chamber 20 respectively.

The left and right arcs 3, 4 are alternately arranged in the valve chamber 20 between the air inlet 23 and the air outlet 24, and each of the left and right arcs is coupled between the inner membranes 21, 22, and lower arcs 32, 42 at the bottom of the left and right arcs 3, 4 are extended to a central axis 202 of the air inlet 23 and the air outlet 24, and a concave arc surface 33, 43 is disposed on a side of the middle section of the left and right arcs 3, 4 and tilted in a direction from the air inlet 23 towards the air outlet 24, and a convex arc surface 34, 44 is disposed on the other side of the middle section of the left and right arcs 3, 4 and tilted in a direction from the air outlet 24 towards the air inlet 23.

The air route 5 in a curved shape is formed among the air inlet 23, the concave arc surface 33, 43 and the air outlet 24 to guide the air to flow from the air inlet 23 to the air outlet 24 along the concave arc surface 33, 43 to enter into the air outlet 24 in a curved shape.

There are plural sealed spaces 200 formed between inner walls of the convex arc surfaces 34, 44 and both sides of the valve chamber 20, and the top of the left and right arcs 3, 4 proximate to the air inlet 23 is extended to an inner wall of the valve chamber 20 at the external periphery of the air inlet 23 to block the top of the sealed space 200 from interconnecting to the air inlet 23.

The flow guide passage 52 is formed between adjacent upper and lower convex arc surfaces 34, 44 and left and right arcs 3, 4 and interconnected with the air route 5 and the sealed space 200, and some of the air is guided to flow in a direction from the air outlet 24 along the convex arc surface 34, 44 towards the air inlet 23 to enter into the sealed space 200.

Figure 10:
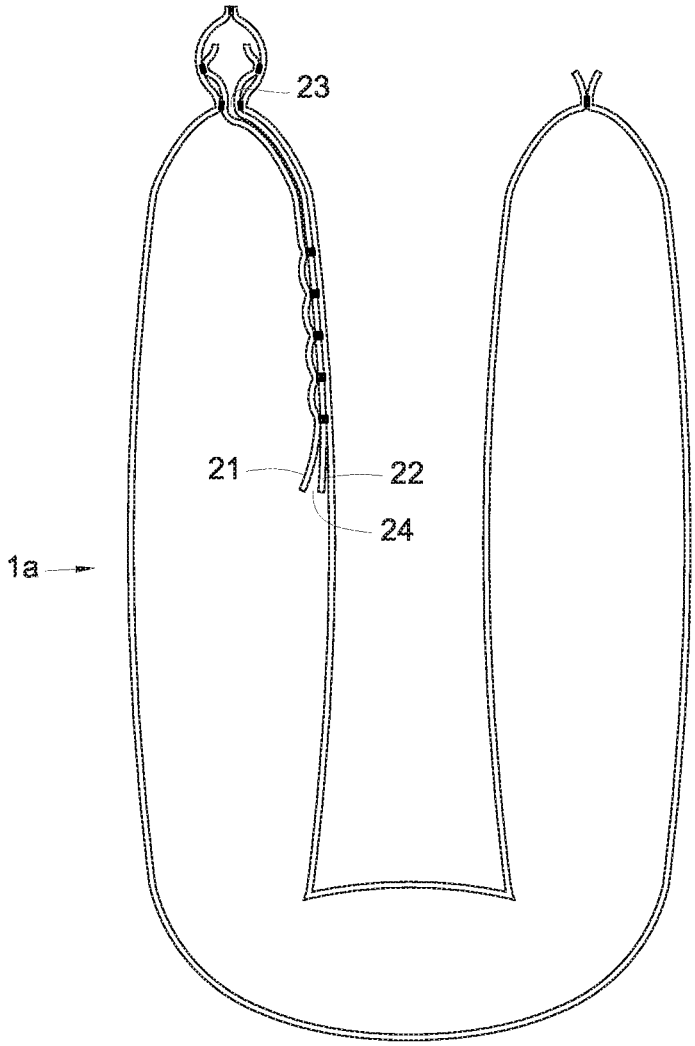
FIG. 10 is a cross-sectional view of the exemplary as depicted in FIG. 2.

In another preferred embodiment, the sealing body 1 can be an airbag used for shock absorption, or the sealing body 1*a* can be an airbag used for packaging (as shown in FIG. 10).

A flow guide portion 311, 411 is formed at the top of the upper arc 31, 41 of the left and right arcs 3, and extended from the sealed space 200, and the flow guide portion 311, 411 is corresponsive to the convex arc surface 34, 44 adjacent to the top.

The lower arcs 32, 42 at the bottom of the left and right arcs 3, 4 on a side of the valve chamber 20 are corresponsive to the concave arc surface 33, 43 of left and right arcs 3, 4 on the other side of the valve chamber 20.

The concave arc surfaces 33, 43 of the left and right arcs 3, 4 on a side of the valve chamber 20 are disposed alternately with the concave arc surface 33, 43 of the left and right arcs 3, 4 on the other side of the valve chamber 20.

The flow guide passage 52 on a side of the valve chamber 20 is corresponsive to the concave arc surface 33, 43 on the other side of the valve chamber 20.

Another preferred embodiment of the present invention is described as follows:

A heat resisting material 6 is coated onto an air inlet formed on an inner side of any inner membrane 21, 22 at the top of the inner membrane 21, 22 in advance, and the heat resisting material 6 can be heat resisting paint. After the inner membranes 21, 22 are put into the outer membranes 11, 12, and a horizontal hot sealing line 7 is hot sealed, but hot sealed inner surfaces of the inner membranes 21, 22 at the position of the heat resisting material 6 is not adhered to form an air inlet 23 of the sealing body 1. When air is inflated, the air passes through the air inlet 23 and flows along the left and right arcs 3, 4 all the way to the air outlet 24 at the bottom of the inner membrane 21, 22 to enter into the air chamber 10 of the sealing body 1.

Each air chamber 10 comprises at least one air inlet 23, and the left and right arcs 3, 4 coupled to the air inlet 23 are sealed at the position of the hot sealing line of the air inlet 23 made of the heat resisting material 6, so that the air route 5 are sealed sideway to prevent back flowing air at the joint of the air inlet 23, the air route 5 and the left and right arcs 3, 4 from flowing along an inflating channel 13 of the sealing body 1 to leak from the sealing body 1.

In the inner membranes 21, 22 and the outer membrane 11, 12 of the sealing body 1, the left and right arcs 3, 4 can be hot sealed first to seal the air stop valve with the outer membranes 11, 12. After the sealing body 1 is inflated, no internal air is expanded to produce an internal pressure, and the air stop valve is compressed and lock to improve the air stopping effect, or the air stop valve can be installed between the outer membranes 11, 12, such that after the sealing body 1 is inflated, the air in the sealing body 1 is expanded to increase the pressure, so that both sides of the air stop valve are pressed to form a lock to improve the air stopping effect.

Figure 5:
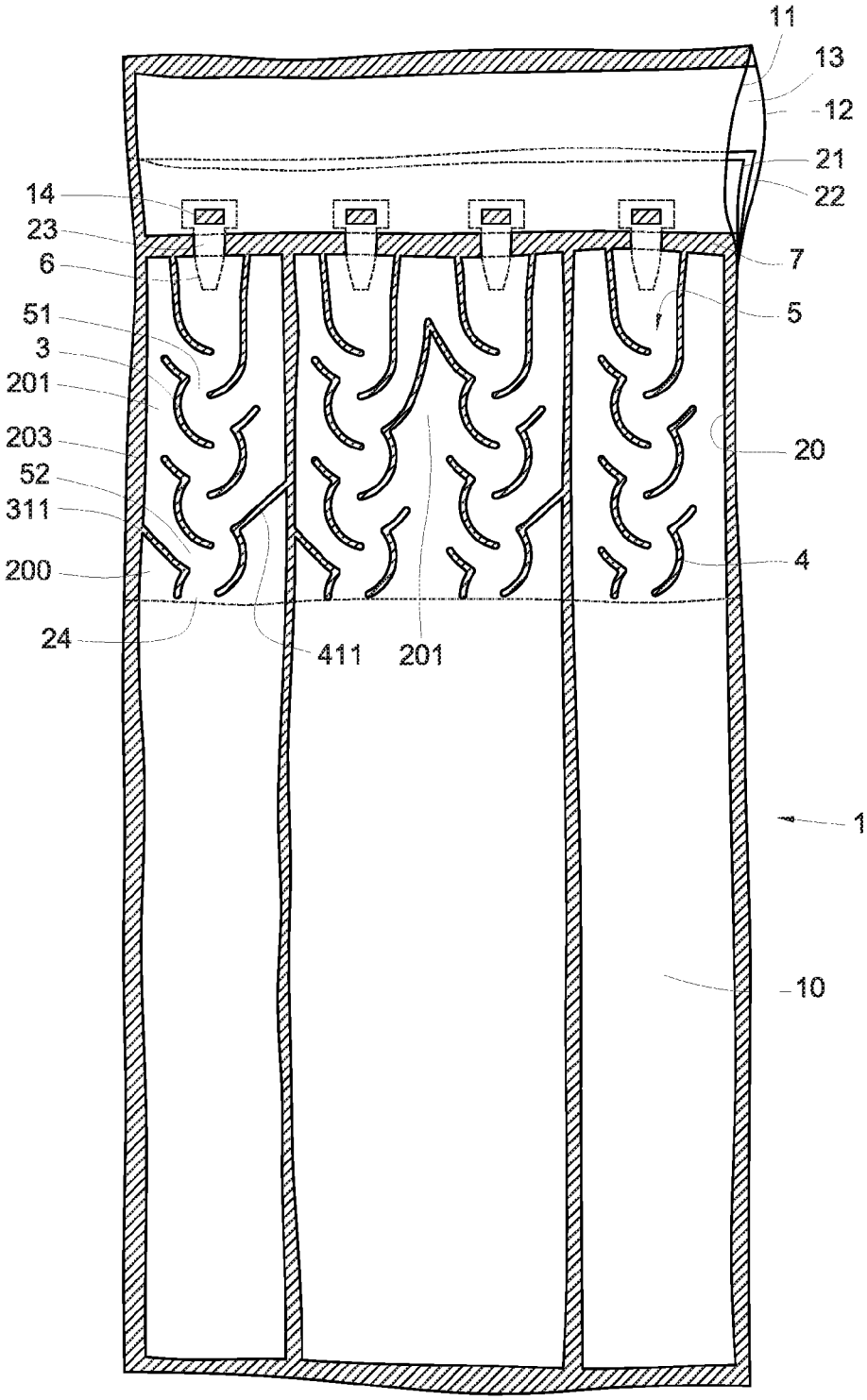
FIG. 5 is another schematic view of an air stop valve in accordance with the preferred embodiment as depicted in FIG. 1.

In use, two outer membranes 11, 12 of the sealing body 1 together with the inner membranes 21, 22 for locking air are hot sealed to form a plurality of independent air chambers 10, and each air chamber has at least one air inlet 23. In FIG. 5, one air chamber 10 comes with one air inlet 23, or one air chamber 10 has one air inlet 23, and then the non-linear air stop valve of the present invention is installed to the air inlet 23.

With the aforementioned structure, when air is filled from the air inlet 23 into the valve chamber 20 and flows along the upper arc 31, the concave arc surface 33, and the lower arc 32 of the left arc 3, so that the air can slide along the concave arc surface 33 and is guided by the concave arc surface 43 of the right arc 4 to switch flowing into the breach 51, and then the air flows along the upper arc 31, the concave arc surface 33 and the lower arc 32 of the left arc 3 at the next level. Therefore, the air can produce right and left turns by its moving direction through the concave arc surfaces 33, 43 breach 51, and enter into the breach 51.

It is noteworthy to point out that the left and right arcs 3, 4 are streamlined and have a low wind resistance, so that the air may slide and turn left or right easily to cause a rotating movement in the air route 5 to expedite the inflation smoothly, and the air keeps on moving from left to right or from right to left, which is equivalent to rotating in a semicircle at the rear end of the lower arcs 32, 42 of the left and right arcs 3, 4. Since the left and right arcs 3, 4 have a low wind resistance coefficient and the displacement is in the shape of a semicircle, the air can be rotated automatically to increase the velocity of flow, so as to speed up the air to flow into the sealing body 1.

Therefore, air is moved nonlinearly from the top to the left, to the right, and to the bottom, and the concave arc surfaces 33, 43 are streamlined to provide a very low wind resistance, and air entering from the air inlet 23 into the left and right arcs 3, 4 produces a whirl in the curved passage. The air will not be blocked by the left and right arcs 3, 4, and the whirl produced by the movement of the air increases the velocity of flow and improves the effect of passing the air through the air route 5 quickly.

After the sealing body 1 is inflated, and the air in the air chamber 10 flows back along the original air route, the air is blocked by the lower arcs 32, 42 of the left and right arcs 3, 4, so that approximately one half of the air flows along the convex arc surfaces 34, 44, and directed from the flow guide passage 52 to flow into the sealed space 200 while the other half of the air flows back from the breach 51 to the air route 5, and this half of air is blocked by the lower arcs 32, 42 and the convex arc surfaces 34, 44 of the left and right arcs 3, 4, and finally a very small amount of air flows back to the air inlet 23 to achieve the objective of the present invention.

Therefore, when the air in the sealing body 1 flows back along the path of the air inlet of the air stop valve, the air is blocked and guided by the left and right arcs 3, 4, and the back flowing air is divided, such that a very small quantity of air will flow back to the air inlet 23 to achieve the effect of preventing the backflow, without causing difficulties or unsmooth operations of the inflation. As a result, the air sealing body 1 of the invention can maintain a good buffering condition.

Figure 6:
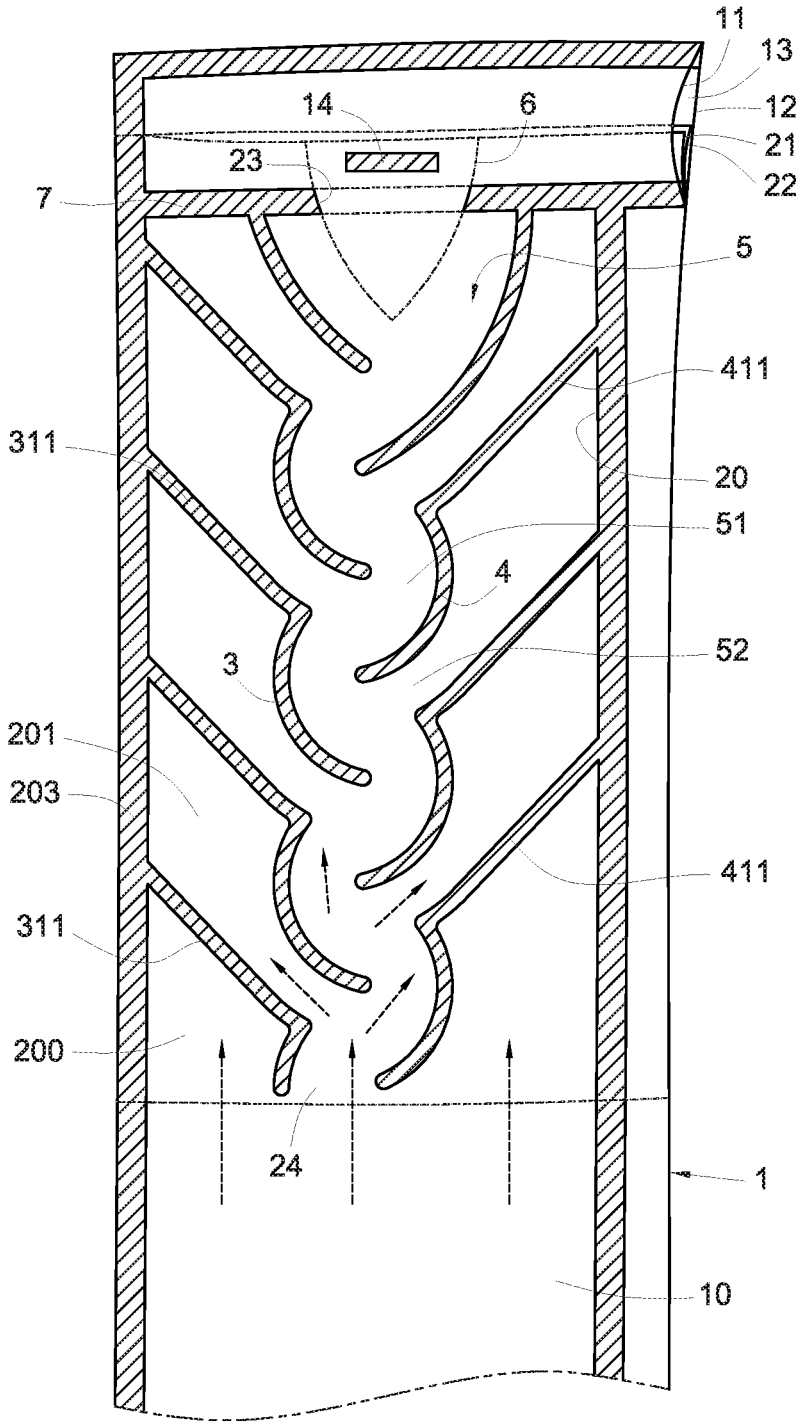
FIG. 6 is a further schematic view of an air stop valve in accordance with the preferred embodiment as depicted in FIG. 1.

In use, the hot sealing length at the flow guide portions 311, 411 of the flow guide passage 52 can be extended to a boundary 203 of the sealed space 200 (as shown in FIGS. 5 and 6), such that the sealed space 200 can be divided into a plurality of independent sealed chambers 201, and adjacent flow guide portions 311, 411 can be coupled with one another, so that the air guided by the flow guide passage 52 will not be overlapped or interfered with one another.

Figure 7:
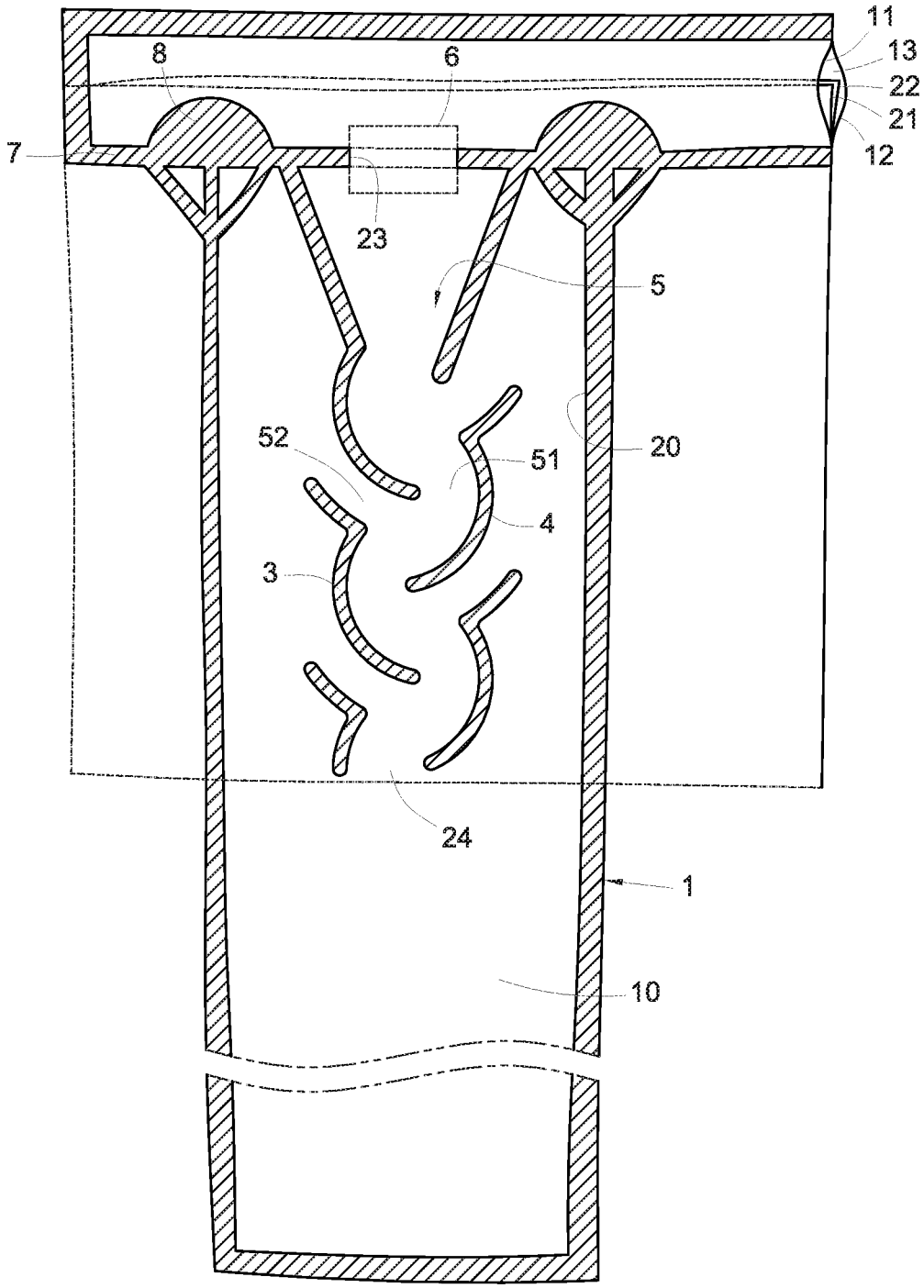
FIG. 7 is a schematic view of an air stop valve in accordance with an exemplary of the present invention.
Figure 8:
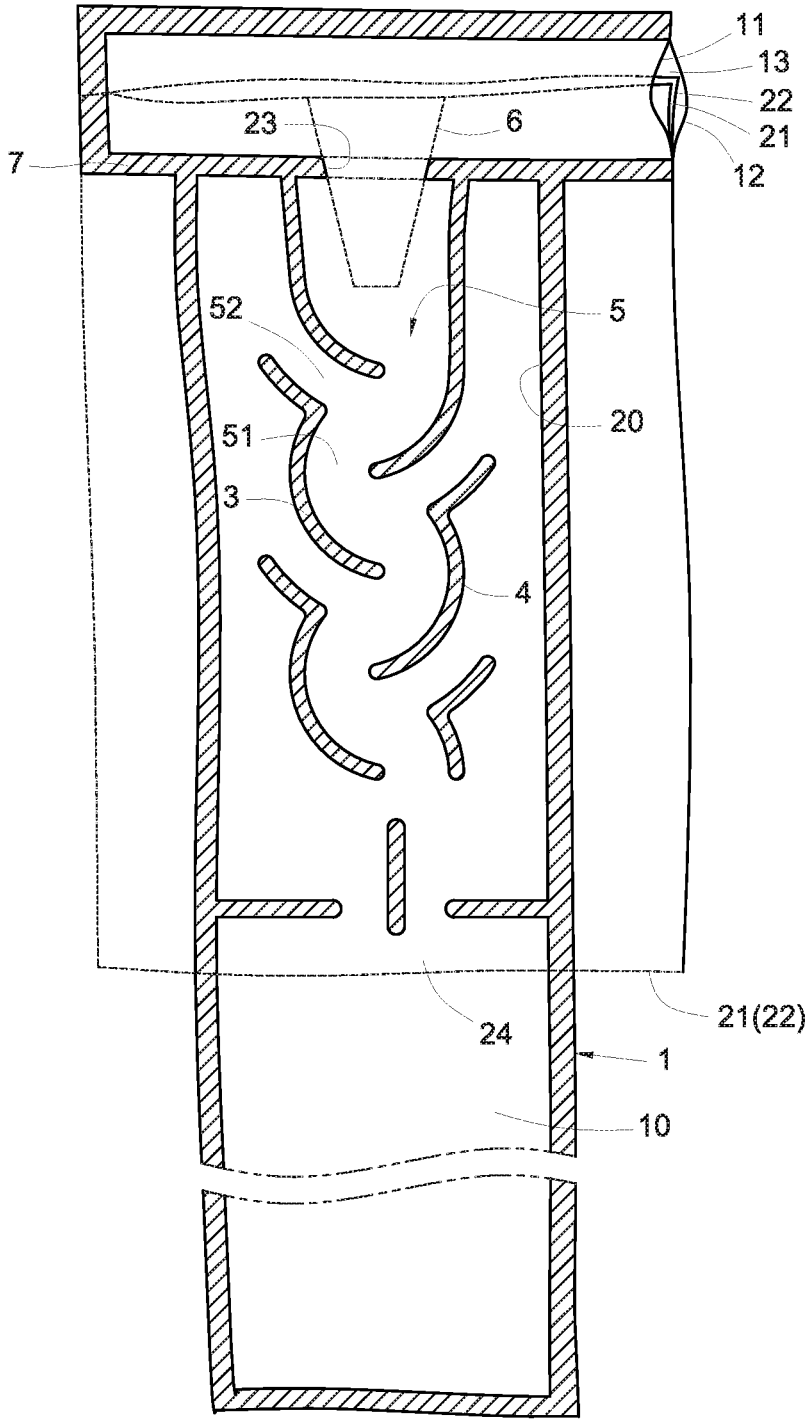
FIG. 8 is a schematic view of an air stop valve in accordance with another exemplary of the present invention.

In use, the air route 5 can be of the nonlinear method together with the conventional linear method (as shown in FIGS. 7 and 8) depending on the use with the upper section or both upper and lower sections. In FIG. 7, the upper section adopts the conventional linear method, and the lower section adopts the nonlinear method. In FIG. 8, the upper section adopts the nonlinear method, and the lower section adopts the conventional linear method.

Figure 9:
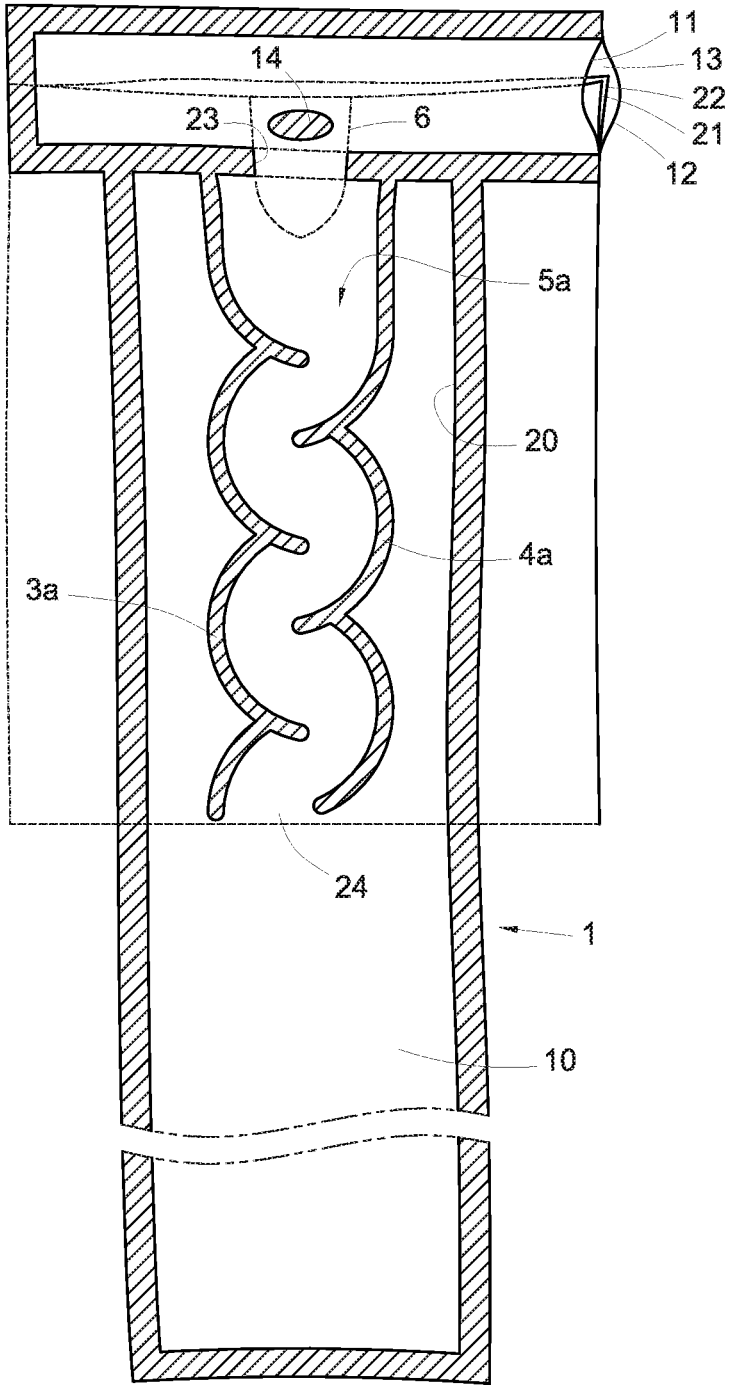
FIG. 9 is a schematic view of an air stop valve in accordance with a further exemplary of the present invention.

In use, the left and right arcs 3*a*, 4*a* are arranged asymmetrically (as shown in FIG. 9), and the arcs 3*a*, 4*a* at the top and the bottom are coupled all the way to the bottom of the inner membrane 21, 22 to define a sealed air route 5*a*.

In addition, the air stop valve can be used independently, or installed continuously with a continuous air-column type air sealing body 1 (as shown in FIGS. 1 and 5). When the inflating channel 13 of the continuous air column type air sealing body 1 is inflated, the air inlet 23 of the continuously installed air stop valve can be opened automatically. In addition, the heat resisting material 6 presets on the inner membrane 21, 22 can be extended onto the inflating channel 13, and a hot-sealing node 14 is formed at the inner membranes 21, 22 and the outer membranes 11, 12 on the heat resisting material 6. Since a heat resisting material 6 is coated on an inner side of the inner membrane 21, 22, therefore the inner side of the inner membrane 21, 22 will not be adhered during the hot sealing process, and the inner membrane 21, 22 and the outer membrane 11, 12 will be coupled by the hot sealing process. When the inflating channel 13 is inflated and expanded, the outer membranes 11, 12 will be spread open, so that the coupled outer membranes 11, 12 and inner membranes 21, 22 can be pulled open together to inflate the inflating channel 13 naturally and pull open the inner membrane 21, 22 and the air inlet 23 automatically.

In addition, another preferred embodiment of automatically open the air inlet 23, the heat resisting material 6 extended to the components 21, 22 is skipped, but the inflating channel 13 has the inner membranes 21, 22 and the outer membranes 11, 12 hot sealed directly on both sides of the air inlet 23 of the air column to form a stacked hot-sealed block 8 (as shown in FIG. 7). The main purpose to prevent the hot-sealed block 8 from being expanded or contracted during the inflation, while the inflating channel 13 is inflated, so as to drive the hot-sealed block 8 to compress against the air inlet 23 to open the air inlet 23 automatically.

What is claimed is:

1. A nonlinear air stop valve structure, with two narrower plastic inner membranes disposed in two wider plastic outer membranes, and assembled in an air sealing body, comprising:

a plurality of arcs, formed and disposed on both sides of the inner membranes by hot sealing, and comprising a plurality of left arcs and a plurality of right arcs disposed on the both sides of the inner membranes, the left arcs and right arcs being arranged asymmetrically, and each of the left arcs and each of the right arcs cooperatively forming a breach at an end-point of the left arc and the right arc, the breach disposed adjacent to a concave arc surface of either the left or the right arc opposite to the breach, and the plurality of left and right arcs being arranged on left and right sides between a hot sealing line to an air outlet to form a nonlinear air stop valve structure;

such that after the sealing body is inflated through the air stop valve structure, air enters from an air inlet at a top of the inner membranes and flows along an upper arc of each of the left and right arcs to a lower arc, and the air is blocked by the concave arc surface and switched to pass through the breach, and guided from either the left or right arc which is opposite to the concave arc surface to the lower arc of either the left or right arc to flow into the breach, so as to constitute an airflow passing through the right arc, the breach, the left arc and the breach in turn from right to left or from left to right into the air outlet formed at the bottom of the inner membranes and enter into the scaling body.

2. The nonlinear air stop valve structure of claim 1, wherein a heat resisting material is coated at a predetermined position of the air inlet formed on an inner side of either one of the inner membranes, such that after the inner membranes are placed into the outer membranes and thermally sealed with the horizontal hot sealing line, an inner side of the inner membrane at the position of the heat resisting material is not thermally sealed or coupled to form the air inlet of the sealing body, and air passes through the air inlet and circulates along the left and right arcs and flows all the way to the air outlet formed at the bottom of the inner membranes to enter into the sealing body, when the sealing body is inflated.

3. The nonlinear air stop valve structure of claim 1, further comprising a flow guide passage preset between the upper and lower arcs for guiding backflow air, and using a lower end of the left or right arc as a natural block when the air flows back, so that the backflow air is blocked by the lower end of the left or right arc, and the flow guide passage guides air being blocked accordingly into a sealed space, thereby preventing a gas or air stored in the sealing body from flowing back to the air inlet and prevent a backflow, so that the sealing body is capable of maintaining a long air-lock time to assure a buffering capability of the sealing body.

4. The nonlinear air stop valve structure of claim 3, wherein the flow guide passage has a hot-sealing length extended to a boundary of the sealed space, so that the sealed space is partitioned into a plurality of independent sealed chambers, and gas guided from the flow guide passage will not be overlapped or interfered.

5. The nonlinear air stop valve structure of claim 1, wherein the inner membranes and a single outer membrane of the sealing body are hot sealed with the left and right arcs in advance to form a seal between the air stop valve and the Single outer membrane, and after the sealing body is inflated, there is no internal expansion, thus an internal pressure is produced to compress the air stop valve to define an air stop and improve an air stopping effect.

6. The nonlinear air stop valve structure of claim 1, wherein the air stop valve is installed independently between the outer membranes, and after the sealing body is inflated, an internal pressure of the sealing body increases due to the expansion of air, so that both sides of the air stop valve are pressed to form an air stop to improve an air stopping effect.

7. The nonlinear air stop valve structure of claim 1, wherein an air route from the air inlet to the air outlet is formed between the left arc and the right arc, and the air route is used together with a conventional linear method by a nonlinear method, and the air route is used together with an upper section, or both the upper and an lower section.

8. The nonlinear air stop valve structure of claim 1, wherein the sealing body comprises at least one air chamber formed therein and disposed between the outer membranes, and each air chamber comprises an air inlet, and the left and right arcs coupled to the air inlet and the air inlet hot sealing line of the heat resisting material are coupled closely with one another to prevent the air from flowing back through the air inlet to an inflating channel of the sealing body to leak from the sealing body.

9. The nonlinear air stop valve structure of claim 1, wherein the quantity of the left and right arcs arranged at the top and bottom and the spacing between the left and right arcs and the breach are determined according to actual requirements.

10. The nonlinear air stop valve structure of claim 1, wherein the air stop valve is used separately, or installed continuously on a continuous air column type air sealing body, and when an inflating channel of the continuous air column type air sealing body is inflated, the air inlet of the continuously installed air stop valve is capable of being opened automatically, and one of the inner membranes further includes a heat resisting material extended to the inflating channel and a hot-sealing node formed on the heat resisting material between the inner membranes and the outer membranes in advance, and since an inner side of the one of the inner membranes is coated with the heat resisting material, the inner side of the one of the inner membranes is not adhered to an opposite side of the inner membranes when hot sealing, and the inner membranes and the outer membranes are adhered by hot sealing, and when the inflating channel is inflated and expanded, the outer membranes are spread outwardly to pull both of the outer the inner membranes outwardly, so as to naturally inflate the inflating channel and automatically pull open the inner membranes and the air inlet.

11. The nonlinear air stop valve structure of claim 10, further comprising the continuous air column type air sealing body, and the inflating channel having no hot-sealing node but using an inflating channel instead, and two of the inner membranes and two of the outer membranes of the air column adjacent to the air inlet being hot sealed to form a hot-sealed block, such that when the inflating channel is inflated, the hot-sealed block does not inflate or expand, the inflating channel with no hot-sealed block is expanded or contracted due to inflation to drive the two hot-sealed blocks to compress the air inlet to open the air inlet automatically.

12. The nonlinear air stop valve structure of claim 1, a top and a bottom of each of the left and right arcs are connected all the way to the bottom of the inner membranes to form a sealed air route.

* * * * *